US007103993B2

(12) United States Patent
Sakai

(10) Patent No.: US 7,103,993 B2
(45) Date of Patent: Sep. 12, 2006

(54) INDEPENDENT ADJUSTMENT FOR SANDAL SINGLE STRAP SYSTEM

(75) Inventor: Kurtis Sakai, Ventura, CA (US)

(73) Assignee: Deckers Outdoor Corporation, Goleta, CA (US)

( * ) Notice: Subject to any disclaimer, the term of this patent is extended or adjusted under 35 U.S.C. 154(b) by 271 days.

(21) Appl. No.: 10/862,091

(22) Filed: Jun. 4, 2004

(65) Prior Publication Data

US 2005/0268485 A1 Dec. 8, 2005

(51) Int. Cl.
*A43B 3/12* (2006.01)

(52) U.S. Cl. ..... 36/11.5

(58) Field of Classification Search ..... 36/11.5; 24/198, 200

See application file for complete search history.

(56) References Cited

U.S. PATENT DOCUMENTS

| | | | | |
|---|---|---|---|---|
| 950,862 A | | 3/1910 | Nelson | 36/11.5 |
| 2,084,412 A | * | 6/1937 | Schaefer | 24/186 |
| 2,193,943 A | * | 3/1940 | Shea | 36/11.5 |
| 2,259,273 A | * | 10/1941 | Smith | 36/11.5 |
| 2,788,591 A | * | 4/1957 | Gibson | 36/11.5 |
| 4,793,075 A | | 12/1988 | Thatcher | 36/11.5 |
| 4,817,302 A | | 4/1989 | Saltsman | 36/11.5 |
| 4,920,664 A | * | 5/1990 | McGregor et al. | 36/11.5 |
| 5,056,241 A | | 10/1991 | Young | 36/11.5 |
| 5,228,216 A | | 7/1993 | Sargeant | 36/11.5 |
| 6,237,250 B1 | | 5/2001 | Aguerre | 36/11.5 |
| 6,606,803 B1 | | 8/2003 | Ritter et al. | 36/11.5 |
| 6,637,130 B1 | | 10/2003 | Urie et al. | 36/11.5 |

* cited by examiner

*Primary Examiner*—Ted Kavanaugh
(74) *Attorney, Agent, or Firm*—Greer, Burns & Crain, LTD

(57) ABSTRACT

A sandal having a sole and at least one heel post attached to the sole is provided, with a continuous strap attached to the heel post and the sole. The strap has an instep portion located forward of the heel post and a heel portion located rearward of the heel post. The length of the continuous strap is adjusted with an adjustable fastener, and the lengths of the instep portion and the heel portion are independently and selectively adjusted with at least one cleat.

6 Claims, 6 Drawing Sheets

INDEPENDENT ADJUSTMENT FOR SANDAL SINGLE STRAP SYSTEM

FIELD OF THE INVENTION

The present invention relates to sport sandals. More specifically, the invention relates to strapping systems for securely affixing a sport sandal to a user's foot and for providing adjustability in the strapping system.

BACKGROUND OF THE INVENTION

Sport sandals have been developed to enable the user to perform active, athletic activities. Examples of two types of sport sandals are disclosed in U.S. Pat. Nos. 4,584,782 and 4,793,075 to Thatcher which incorporate an adjustable toe strap, an adjustable ankle strap, an adjustable heel strap and a lateral strap to retain the sandal on the user's foot.

As sandals have become more widely worn in athletic activities, the demands on the strapping systems have increased and changed depending on the particular use. The comfort and ease of use of a particular sport sandal in conjunction with the intended use of the sport sandal can dictate how the strapping systems are configured. In addition, variations in each individual user's foot require the strapping system to provide maximum adjustability to accommodate a wide range of foot shapes.

In sport sandal strapping systems a problem arises in the comfort of the strap across the instep portion of the foot, particularly in known strapping systems that encircle the ankle. As the foot undergoes a normal walking progression, the angle between the foot and the ankle changes and muscles flex and release. In turn, the distance around the ankle and the instep changes with the flexure and release of the muscles and the change in angle. A strapping system that encircles the ankle can be restrictive of the foot's motion if the strap is taut in the relaxed state, or may be too loose to adequately retain the sandal on the foot if the strap is taut only in a flexed state.

Continuous strap systems are also known which contact the foot in multiple locations. While continuous strapping systems can be easily assembled and can provide adjustability, similar problems with the tension in the strapping system over the wide range of foot movement are common. In addition, in conventional continuous strapping systems, the portions of the strap contacting individual portions of the foot cannot be individually adjusted.

Accordingly, there is a need for a sport sandal strapping system which is intended for use during active, athletic activities that accommodates the foot over a wide range of movement.

There is a further need for a sport sandal strapping system which incorporates a continuous single strap around the ankle and the instep that provides individual, comfortable fits around the ankle and the instep.

Another need is for a continuous strapping system which allows different portions of the strap to be independently adjusted.

BRIEF SUMMARY OF THE INVENTION

In accordance with the invention, the above-listed needs are met or exceeded by a unique sandal strapping system. A sandal having a sole and at least one heel post attached to the sole is provided. A continuous strap is attached to the heel post and the sole, and has an instep portion located forward of the heel post and a heel portion located rearward of the heel post. The length of the heel portions is independently adjusted with at least one cleat, and the length of the instep portion is then selectively adjusted with an adjustable fastener.

In a preferred embodiment, the sandal has a sole with a heel portion and a forefoot portion. On the medial side of the sole, a medial heel post is attached to the heel portion of the sole. A medial cleat is attached to the medial heel post. On the lateral side of the sole, a lateral heel post is attached to the heel portion of the sole. A lateral cleat is attached to the lateral heel post. A continuous strap has a heel portion extending between the cleats and instep portions extending from the cleats to the sole of the sandal and including an adjustable fastener for adjusting the length of the strap. The heel portion is cinched to the desired tension between the cleats, whereafter the instep portions are drawn to the desired tension and secured in place by the fastener.

Another feature of the present invention is a strapping system for a sandal having a continuous strap and a sole with a heel portion and a forefoot portion. Extending upwardly from the heel portion are lateral and medial heel posts. An instep portion located forward of the heel posts and a heel portion located rearward of the heel posts. The system includes means for adjusting and fixing the tension in the heel portion of the continuous strap independently from the instep portion.

Also provided is a heel support having a body attached to and extending upwardly from the heel end of the sandal sole. The heel support has a pair of spaced apart fins which are attached to and extend upwardly from the heel support body. The fins are connected to the heel strap such that when the heel strap is tensioned, the heel strap cinches the fins inwardly to engage and grip a user's heel to the lateral and medial sides of the Achilles tendon.

Another feature of the present invention is a cleat for a sandal having a strap around the heel of a user. The cleat has an inner surface facing the heel of the user, and an outer surface opposite the inner surface. Extending from the inner surface to the outer surface are an upper strap passage and a lower strap passage. The inner surface of the cleat has teeth for gripping and holding the strap in an adjusted position. A heel post attaches the cleat to the sole of the sandal.

DETAILED DESCRIPTION OF THE INVENTION

Figure 1:
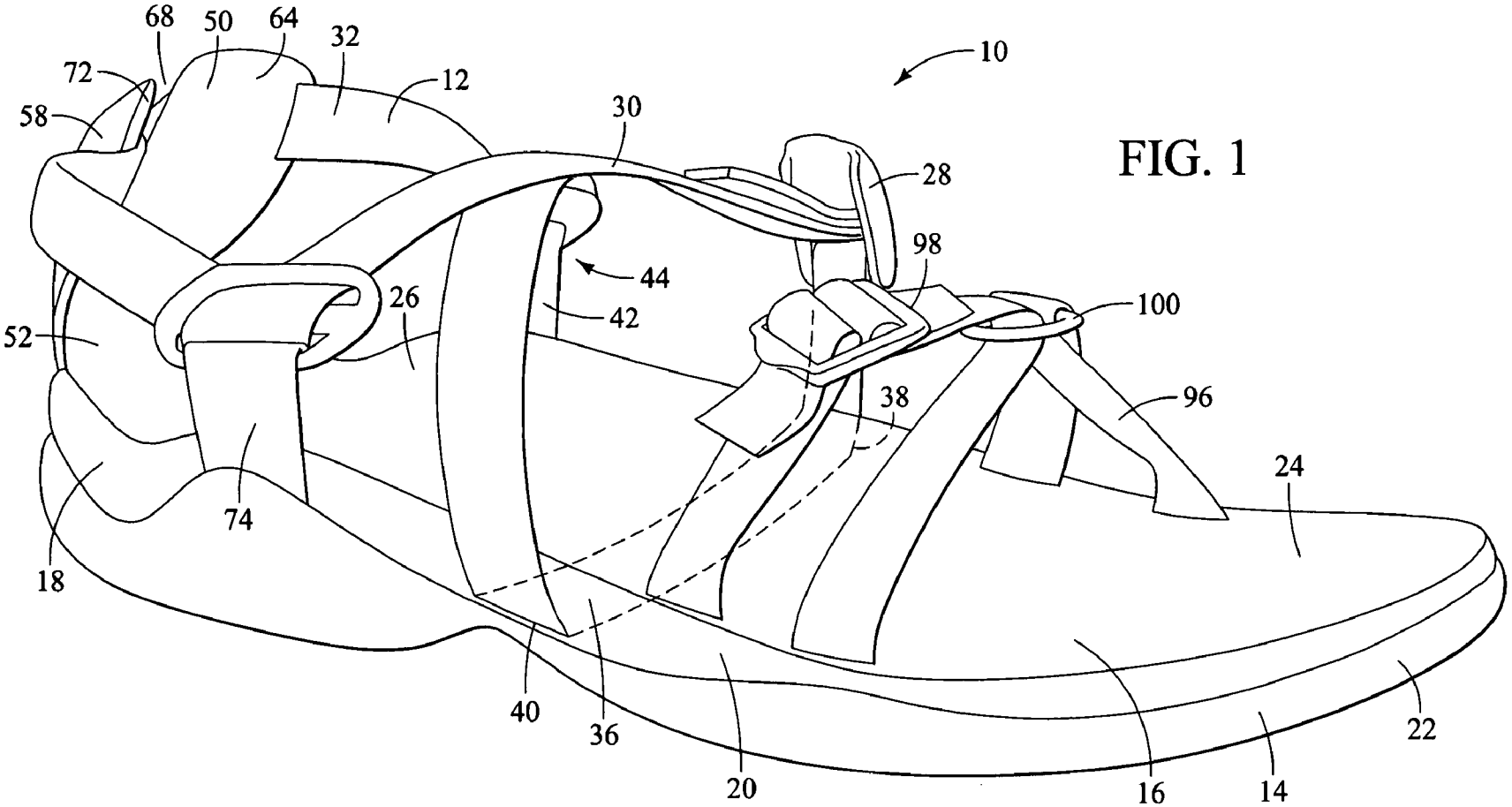
FIG. 1 is a front, lateral side perspective view of a sandal incorporating the strapping system of the present invention.

Referring to FIG. 1, a sport sandal incorporating an independently adjustable continuous strapping system encircling the heel and instep is generally designated 10. The sandal 10 has a continuous heel and instep strap 12 and a sole 14 including a forefoot portion 16, a heel portion 18 and a midfoot portion 20.

Preferably, the sole 14 is configured to the profile of the plantar surface of human foot, having an outsole 22 and an insole 24 with a generally wedge shaped arch 26. The sole 14 is preferably fabricated from stiff and resilient material, such as polyurethane, dual density SSR rubber, vulcanized rubber or ethyl vinyl acetate (EVA), and may include a plurality of different materials in different locations to provide varying amounts of support to different parts of the foot. Further, the sole 14 may be provided with a microban zinc based anti-microbial protectant. In addition, other elements such as shock pads and shanks may be incorporated in the sole 14.

The continuous strap 12 is fabricated from any suitable flexible material having a tensile strength sufficient to maintain the sandal 10 on the user's foot, such as woven fabric or leather, or any material known in the art. The continuous strap 12 is preferably operatively attached at one end to an adjustable fastener such as an adjustable length buckle 28, and travels from the buckle to the medial side of the midfoot portion 20.

The continuous strap 12 has an instep portion 30 which traverses a path around the instep of the foot and a heel portion 32 which extends around the back of the heel of the user, preferably forming a continuous loop.

A channel 36 extends transversely through the sole 14, preferably through the midfoot portion 20 of the sole. The strap 12 enters a medial side channel opening 38 and emerges at a lateral side channel opening 40 and preferably slides freely through the channel 36. This configuration provides a dynamic self-adjusting fit of the strap 12 since the channel 36 allows movement of the strap in response to foot movement. However, other ways of attaching the continuous strap 12 to the sole 14 are contemplated, such as fixedly attaching the strap to the lateral and medial sides of the sole.

Figure 2:
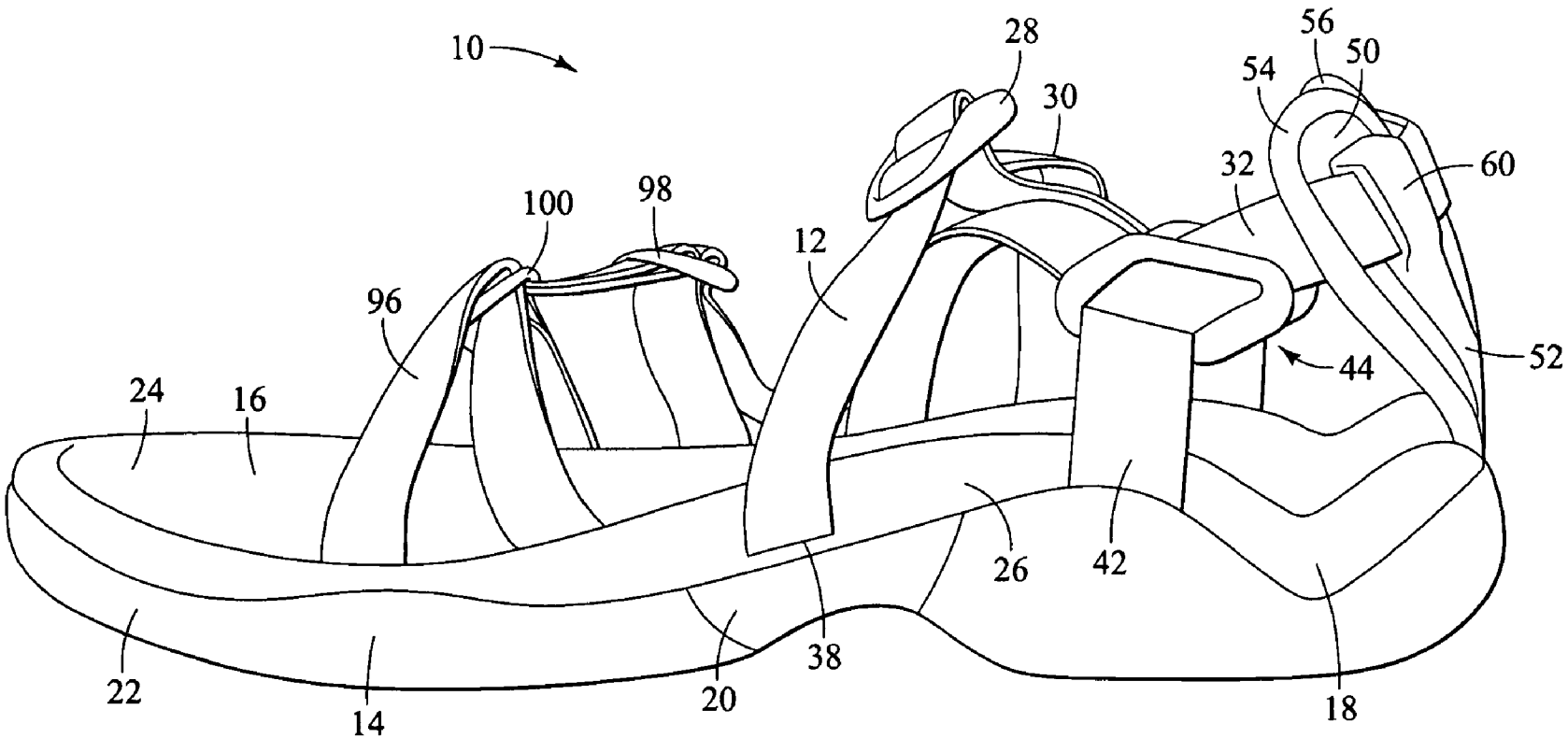
FIG. 2 is a medial side elevational view of the sandal of FIG. 1.

From the channel opening 40 on the lateral side, the strap 12 angles transversely across the instep of a user's foot back to the medial side of the heel portion 18. Referring to FIG. 2, a medial heel post 42 is provided at the heel portion 18 and includes a medial cleat 44 for adjustably receiving the strap 12.

Figure 3:
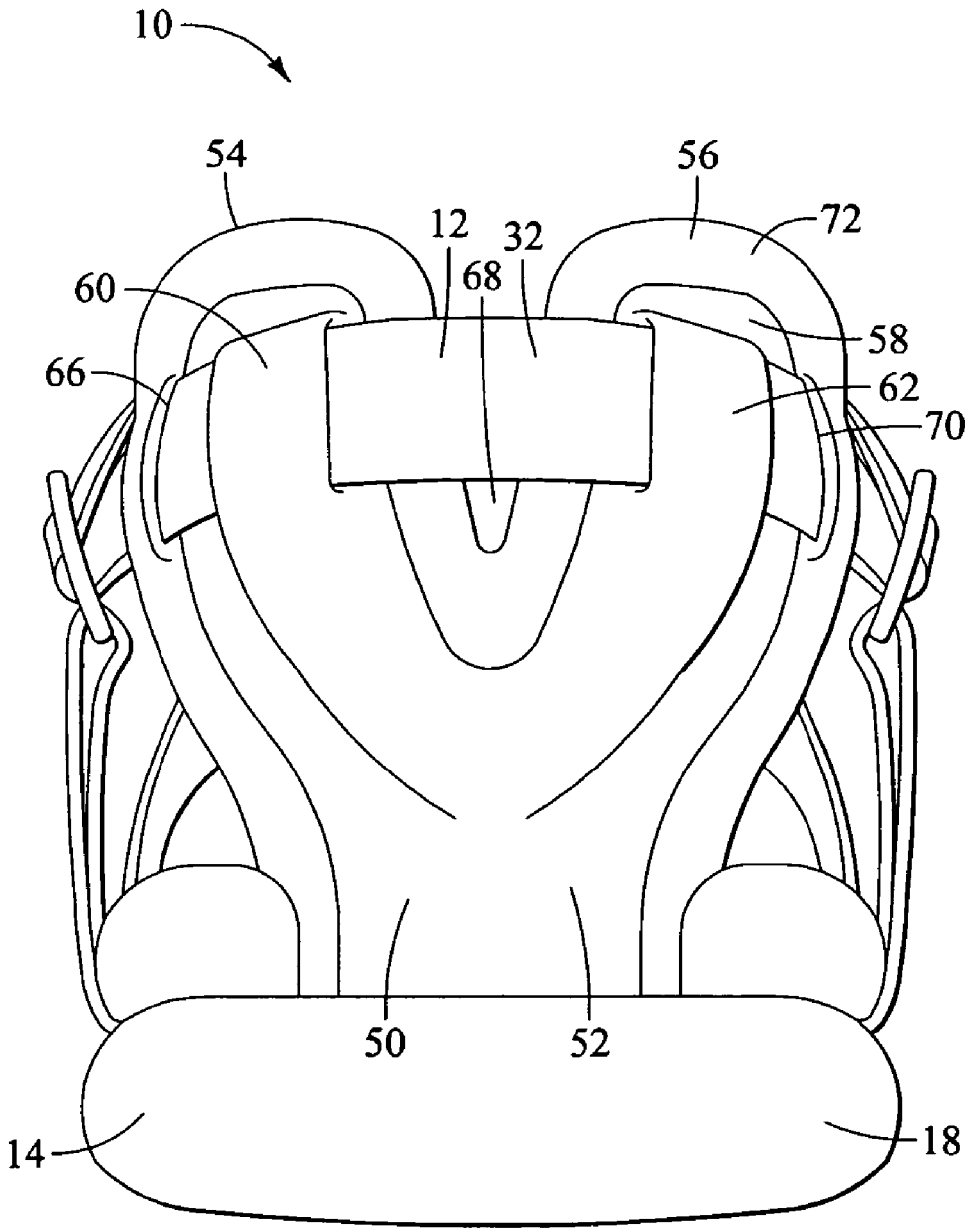
FIG. 3 is a back view of the heel of the sandal of FIG. 1.

The strap 12 then extends rearwardly of the medial heel post 42 and cleat 44, with the heel portion 32 of the strap extending through a back of the heel support 50. Referring to FIG. 3, the heel support 50 has a body 52 that is attached to and extends upward from the heel portion 18 of the sole 14. A vertical gap 68 is formed in the center of the upper end of the body 52 and defines first and second fins 54, 56 extending upward on opposite sides of the ankle. The heel support 50 thus has a general "whale tail" configuration. On the outside-facing side 58 of the first and second fins 54, 56, first and second strap connectors 60, 62 are disposed to slidably to connect the strap 12 to the heel support 50.

In the preferred embodiment, the strap 12 traverses from the medial heel post cleat 44 to the heel support 50. As the strap 12 approaches the heel support 50, the strap travels from an inside-facing side 64 of the heel support through a first aperture 66 in the support to the outside-facing side 58 of the heel support. From the outside-facing side 58, the strap is threaded through the first strap connector 60 which is located at the medial side of the Achilles tendon. The connecter maintains the strap 12 in position with respect to the heel support 50. After traversing the gap 68 between the first and second fins 54, 56, the strap 12 is threaded through the second strap connector 62 which is similar to the first strap connector 60, and located on the lateral side of the Achilles tendon. The strap then passes from the outside to the inside of the support 50 through a second aperture 70.

When the strap 12 is tightened around the back of the heel, the heel support 50 is displaced towards the user's foot. The heel support 50 is made of a pliable and resilient material, such as injection molded plastic or ethyl vinyl acetate, such that the two fins 54, 56 of the heel support 50 can be urged inward and cinched together to engage and grip a user's heel at the lateral and medial sides of the Achilles tendon. A cushion 72 is preferably disposed on the inside of the heel support 50 for added comfort when the support contacts the heel of the user. Although the preferred embodiment of the heel support is of a "whale-tail" shape, it is contemplated that other shapes and arrangements which provide a snug fit around the heel can be used, such as a "V" shape or two distinct supports.

Referring to FIG. 1, a lateral heel post 74, preferably identical or similar to the medial heel post 42, carries a lateral cleat 76, preferably identical or similar to the medial cleat 44, through which the strap is threaded. Forward of the lateral cleat 76, the free end portion 30 of the strap 12 angles transversely from the medial side of the heel back across the instep of the foot. Preferably at a location approximately midway across the instep, the free end of the strap is engaged with the adjustable length buckle 28.

The strap 12 is independently adjustable rearwardly of the lateral and medial heel posts 74 and 42 and forwardly of the lateral and medial heel posts by engaging the strap with the lateral and medial cleats 76 and 44.

The cleats comprise one-way slip devices which permit adjustment of the length of the heel portion of the strap between the two cleats and resist inadvertent loosening of the heel portion of the strap. Thus, the heel portion of the strap can be independently cinched to a desired tension and to cause the heel pad body 52 and fins 54 and 56 to be comfortably engaged with the heel and the opposite sides on the ankle of the wearer. Once the heel portion of the strap has been appropriately adjusted, the cleats hold the heel portion in that adjusted position. Thereafter, the instep portions of the strap can be drawn up to a desired position of adjustment (without disturbing the adjustment of the heel portion) and secured in independently adjusted position by the buckle 28.

Figure 4:
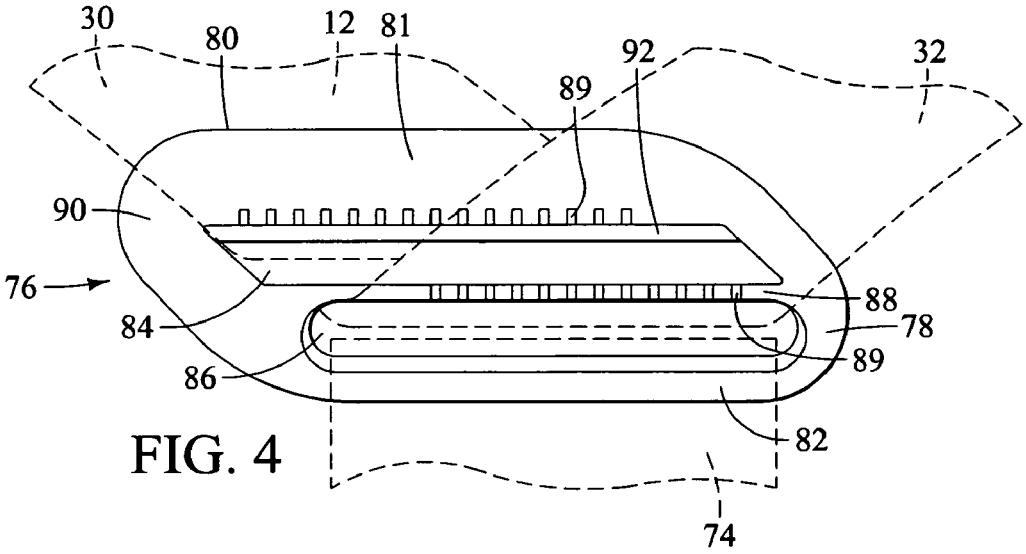
FIG. 4 is an elevational view of a cleat for the sandal of FIG. 1 showing the strap entering and exiting the cleat, as viewed from the inside of the sandal.
Figure 5:
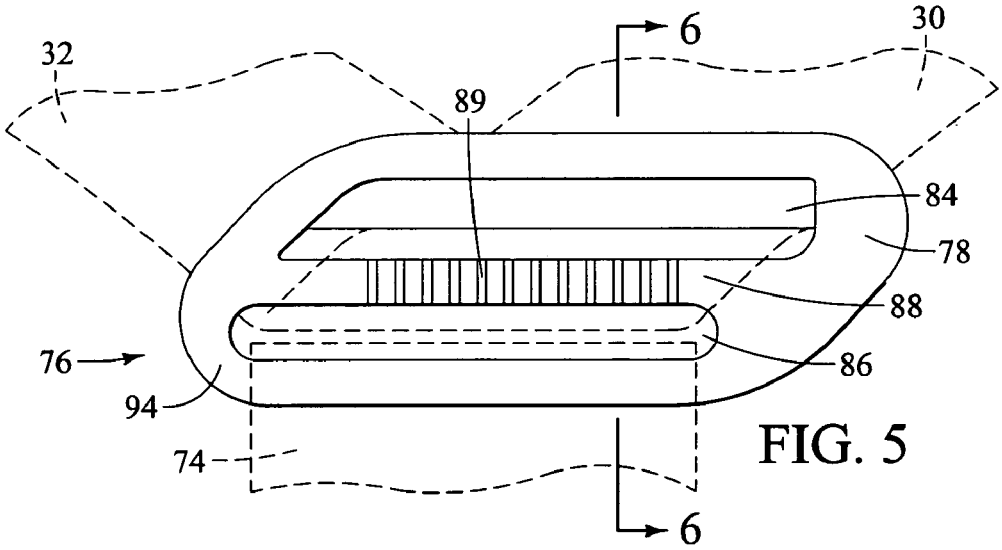
FIG. 5 is an elevational view of the cleat of FIG. 4 as viewed from the outside of the sandal.
Figure 6:
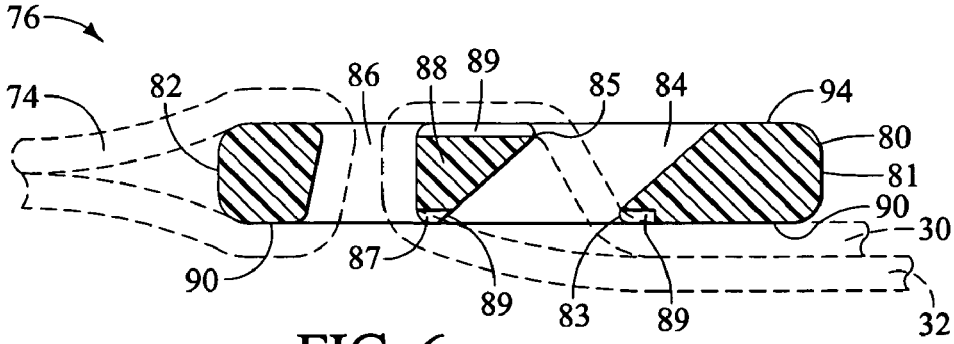
FIG. 6 is a cross section of the cleat of FIG. 4.

As shown with respect to cleat 76 in FIGS. 4–6, each of the cleats comprises a rectangular body 80 having an upper end 81 and a lower end 82 and containing an upper slot or passage 84 and a lower slot or passage 86 separated by a divider 88. The heel post 74 comprises a strap that is passed through the lower slot or passage 86 and doubled back on and secured to itself to mount the cleat on the post.

The upper slot or passage 84 is angled upwardly to define three sharp edges 83, 85 and 87 on the body for engagement with the surfaces of the strap 12. The strap passes over the inner surface 90 of the cleat and through the upper slot 84 where it engages both of the sharp edges or corners 83 and 85. The strap then passes over the outer surface 94 of the divider 88, passes through the lower slot 86, engages the sharp edge or corner 87 and returns to the foot as the instep portion of the strap. Teeth 89 are provided on the body of the cleat at each of its locations or points of contact with the strap, i.e., at edges 83, 85 and 87 and on the outer surface 94 of the divider 88, to secure the strap against inadvertent slippage.

In the preferred embodiment, both heel posts 74, 42 carry cleats 76, 44 in the form described; However, the cleats may take other configurations and shapes without departing from the concept of limiting the movement of the heel strap portion 32 to one direction. In this configuration, the cleats 76, 49 allow movement of the strap 12 in one direction when light tension is applied to the strap.

Figure 7:
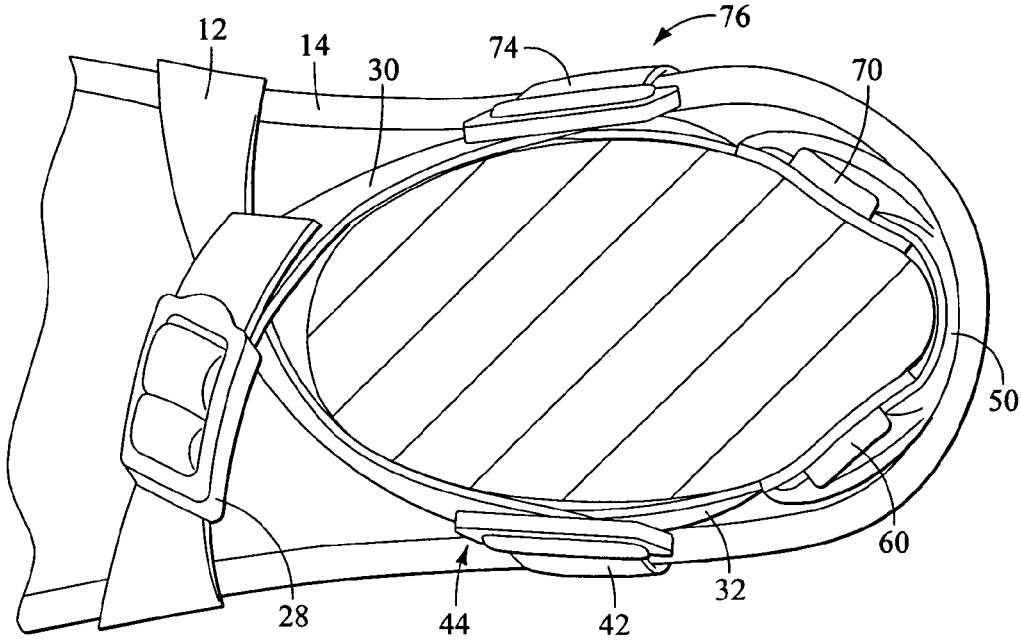
FIG. 7 is a top view of the sandal of FIG. 1 with the strap slightly cinched around the heel and tightened around the forefoot of a user.
Figure 8:
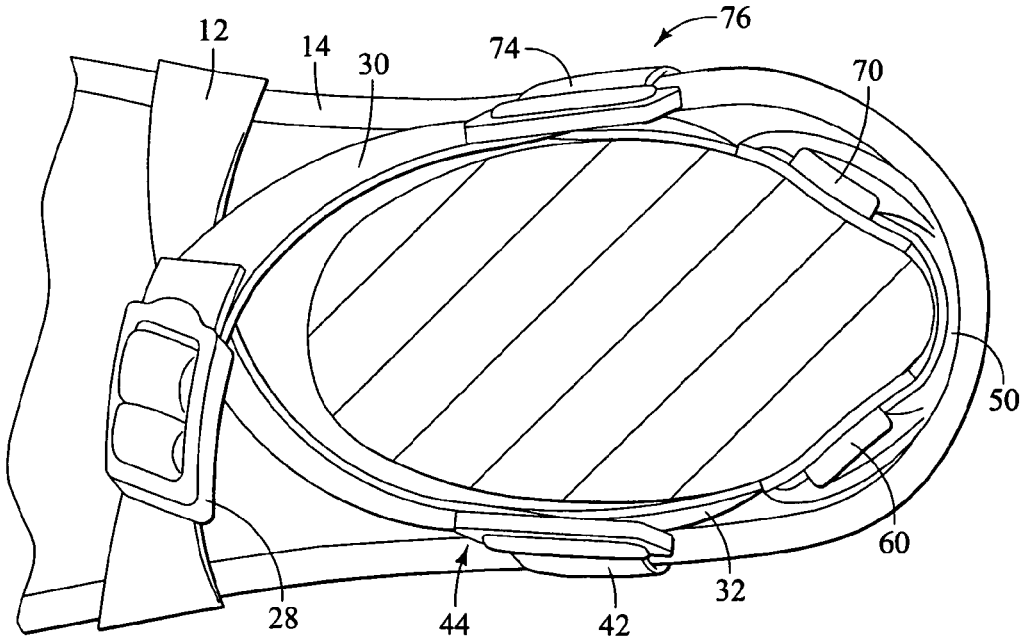
FIG. 8 is a top view of the sandal of FIG. 1 with the strap slightly cinched around the heel and loosened around the forefoot.
Figure 9:
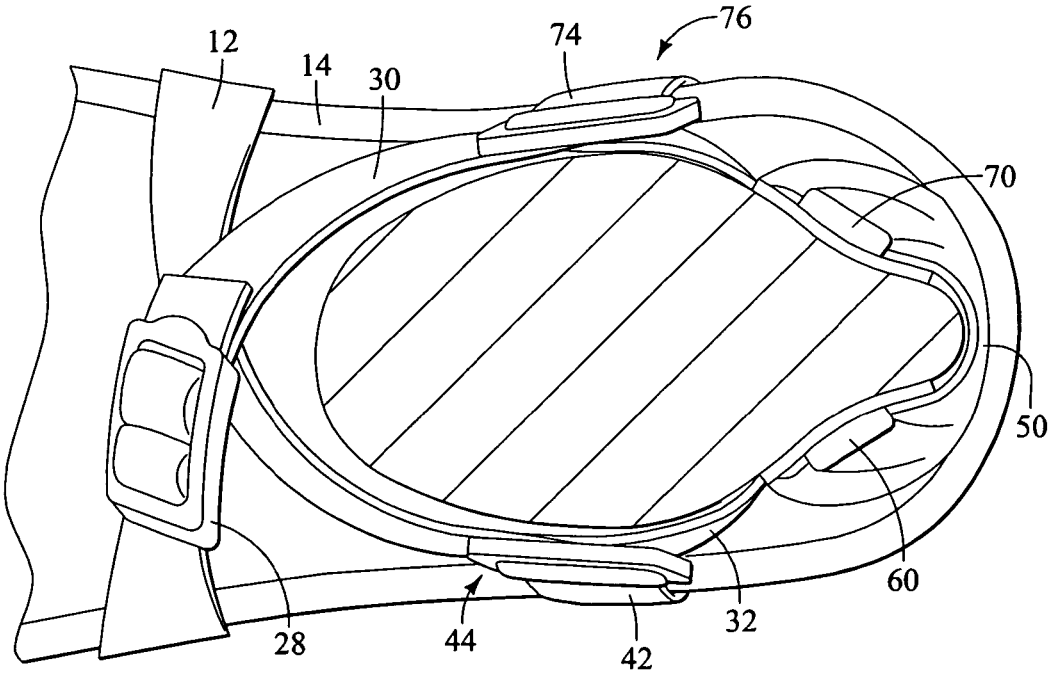
FIG. 9 is a top view of the sandal of FIG. 1 with the strap tightly cinched around the heel and loosened around the forefoot.

Referring to FIGS. 7–9, when the user puts his/her foot into the sandal 10 and cinches the strap heel portion 32 around the heel, the strap 12 will pull through the cleats to the desired length, i.e. the desired tension and amount of cinching. FIGS. 7 and 8 illustrate a user's foot in the sandal with the heel portion 32 slightly cinched to cause the fins 54 and 56 to contact the heel at both sides of the Achilles tendon.

Once the heel strap portion 32 rearward of the heel posts 74, 42 is adjusted, the instep portion 30 of the continuous strap 12 forward of the heel posts can be adjusted independently of and without affecting the tension on the heel strap portion. The adjustable length fastener 28 is used to shorten or lengthen the strap, and adjust the tension on the instep. Although the preferred embodiment incorporates an adjustable length fastener 28 such as a buckle, it will be understood by those skilled in the art that other fasteners providing for adjustability, such as mating hook and loop fasteners, buttons, laces and clips are contemplated.

With the adjustment of the heel portion 32 slightly cinched, in FIG. 7 the instep portion 30 is tightened and in FIG. 8 the instep portion is loosened. In FIG. 9, the heel portion 32 is shown tightly cinched around the heel of the user while the instep portion 30 remains loose.

The sandal 10, in its preferred embodiment, also includes a forefoot strap 96 to adjustably secure the user's forefoot to the sole 14 (best seen in FIG. 1). The following description relates to a preferred embodiment of the forefoot strap 96, however, it should be understood that any forefoot strap configured to retain the forefoot in place against the sole 14 may be employed. Additionally, it is contemplated that the continuous strap 12 can extend to the forefoot to retain the forefoot in place. Alternatively, the forefoot strap 96 can be omitted from the sandal 10.

Preferably, the forefoot strap 96 is provided with a second adjustable length fastener, such as a double ended buckle 98. As shown in FIGS. 1 and 2, the strap 96 extends from the lateral side of the sole transversely over the forefront of the sole to a centrally located pivot ring 100. The strap is looped through the pivot ring and returns to the lateral side. Preferably entering the sole 14, the strap crosses within the sole to the medial side of the sole. Unlike the slidable mounting of the continuous strap 12 within the channel 36, the forefoot strap 96 preferably is not freely movable within the sole but is fixed with respect to the sole. However, the forefoot strap 96 can be moveable within the sole if desired.

Emerging on the medial side of the sole 14, the strap extends to and is looped through the pivot ring 100. From the pivot ring 100, the forefoot strap 96 returns to the medial side and back into the sole 14. From this location, the forefoot strap 96 passes through the sole 14 back to the lateral side, where it emerges to be threaded through the adjustable length fastener 98.

Although the forefoot strap 96 of the preferred embodiment is a single strap, it is contemplated that other configurations can be used, and additionally, that the forefoot strap can be made of individual strap members. Additionally, other types of rings or connections that will allow the several portions of the straps to be connected together at the center of the forefoot may be employed.

While specific embodiments of the strapping system of the present invention have been shown and described, it will be appreciated by those skilled in the art that changes and modifications may be made thereto without departing from the invention in its broader aspects and as set forth in the following claims.

What is claimed is:

1. A sandal comprising:

a sole having a heel portion, a midfoot portion and a forefoot portion;

a medial heel post attached to the heel portion of said sole;

a medial cleat attached to said medial heel post;

a lateral heel post attached to the heel portion of said sole;

a lateral cleat attached to said lateral heel post;

a continuous strap connected to the midfoot portion of said sole and to said medial and lateral cleats, said strap including an instep portion and a heel portion; and at least one adjustable fastener on the instep portion of said strap for adjusting the length of said strap;

said lateral and medial cleats having surfaces engageable with the strap to adjust and fix the length and tension of the heel portion of said strap independently of the length and tension of the instep portion of said strap.

2. The sandal of claim 1 further comprising a channel extending transversely through said sole, said continuous strap extending through and freely moveable within said channel.

3. The sandal of claim 1 further comprising:

a heel support body attached to and extending upwardly from a heel portion of the sandal sole; and a pair of spaced apart fins attached to and extending upwardly from said body, said fins connected to the heel strap such that tensioning of the heel strap cinches the fins inwardly to engage and grip a user's heel at the lateral and medial sides of the Achilles tendon.

4. The sandal of claim 1 wherein each of said cleats comprises:

a body having an inner surface and an outer surface, a first passage and a second passage extending through said body from said inner surface to said outer surface for receiving a strap sequentially from one of said surfaces, through one of said passages to the other of said surfaces and through the other of said passage to said one surface, said body contacting the straps of a plurality of locations for restraining the strap against slippage.

5. The cleat of claim 1 wherein at least one of said passages is angled with respect to said inner and outer surfaces and defines at least one sharp edge on said body for contact with the strap.

6. The cleat of claim 1 wherein said strap contacting locations on said body have teeth for gripping the strap.

* * * * *